US007153223B2

(12) United States Patent
Endo et al.

(10) Patent No.: US 7,153,223 B2
(45) Date of Patent: Dec. 26, 2006

(54) GOLF BALL

(75) Inventors: Seiichiro Endo, Kobe (JP); Keiji Ohama, Kobe (JP); Takahiro Sajima, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/622,568

(22) Filed: Jul. 21, 2003

(65) Prior Publication Data

US 2004/0043835 A1 Mar. 4, 2004

(30) Foreign Application Priority Data

Sep. 3, 2002 (JP) ..... 2002-257247

(51) Int. Cl.
*A63B 37/00* (2006.01)

(52) U.S. Cl. ..... 473/351

(58) Field of Classification Search ..... 473/378, 473/384, 385, 383, 376, 367, 368, 351
See application file for complete search history.

(56) References Cited

U.S. PATENT DOCUMENTS 5,273,287 A 12/1993 Molitor et al.
5,292,132 A 3/1994 Oka
5,344,779 A 9/1994 Kaneko et al.
5,752,889 A * 5/1998 Yamagishi et al. ..... 473/377
5,779,563 A * 7/1998 Yamagishi et al. ..... 473/371
6,315,683 B1 * 11/2001 Yoshida et al. ..... 473/375

FOREIGN PATENT DOCUMENTS

| | | | |
|---|---|---|---|
| GB | 2 321 018 | A | 7/1998 |
| JP | 4-347177 | A | 12/1992 |
| JP | 4-371170 | A | 12/1992 |
| JP | 6-11423 | A | 1/1994 |
| JP | 6-114123 | A | 4/1994 |
| JP | 10-211301 | A | 8/1998 |
| JP | 2001-515394 | A | 9/2001 |
| WO | WO 99/37366 | A1 | 7/1999 |

* cited by examiner

*Primary Examiner*—Raeann Gorden
(74) *Attorney, Agent, or Firm*—Birch, Stewart, Kolasch & Birch, LLP

(57) ABSTRACT

Golf ball 1 has the diameter D of 43.0 mm or greater and 50.0 mm or less. This golf ball 1 includes a core 2 and a cover 3. The core 2 is formed by crosslinking of a rubber composition. The cover 3 is composed of a resin composition. Dimples 4 are formed on the surface of the cover 3. The specific gravity of the cover 3 is 1.05 or greater and 1.50 or less. The moment of inertia of this golf ball 1 is equal to or greater than 85.0 $gcm^2$, and particularly equal to or greater than 88.0 $gcm^2$. The moment of inertia is equal to or greater than the value Y calculated by the following mathematical formula (I):

$$Y=3.57\cdot D-68.6. \quad (I)$$

The weight of the golf ball 1 is 45.00 g or greater and 45.93 g or less.

10 Claims, 2 Drawing Sheets

GOLF BALL

BACKGROUND OF THE INVENTION

1. Field of the Invention

The present invention relates to golf balls. More particularly, the present invention relates to golf balls having a core and a cover.

2. Description of the Related Art

A golf ball hit by a golf club flies through the air and finally falls. During the flight, the golf ball gradually slows down. Great concern of the golfers about the golf balls is their travel distance. Golfers have desired golf balls which are excellent in flight performances. As the speed immediately after impact of the golf ball (initial speed) is greater, the travel distance tends to be longer. Manufactures of the golf ball have made efforts for a long period of time to develop golf balls having high initial speed, however, initial speed which exceeds the currently provided ones is not expected. Such absence of expectation results from the regulation of upper limit of the initial speed of the golf ball defined by United States Golf Association (USGA), and thus initial speed of the golf balls purchased from major manufactures almost attains to this upper limit.

USGA also defines the lower limit of the diameter of a golf ball as 42.67 mm under its rule. In accordance with this rule, only the lower limit of the diameter is defined, but the upper limit is not defined. In other words, a large diameter of a golf ball never makes a ground for judgment of unconformity of the golf ball to the rule. However, the diameter of golf balls which are commercially available is set to be as small as possible in the range to be not less than 42.67 mm because golf balls with a small diameter have small air resistance leading to less deceleration during the flight accordingly. The diameter of all golf balls currently on the market from major manufactures is controlled in the range of from 42.67 mm to 42.80 mm.

In Japanese Patent Publication Reference JP-A-347177/1992, a golf ball having a larger diameter than usual golf balls is disclosed. Because this golf ball is hard to embed into the grass when it is placed on the fairway, it can be hit with ease. According to this golf ball, reduction of the air resistance is contemplated through ingeniously arranging dimples thereby suppressing reduction of the travel distance resulting from the large diameter.

In Japanese Patent Publication Reference JP-A Nos. 11423/1994 and 211301/1998, a golf ball having the elevated moment of inertia is disclosed through making the diameter larger. According to this golf ball, decrease of the travel distance which results from the large diameter is suppressed on behalf of the high moment of inertia.

In Japanese Patent Publication Reference JP-A-515394/2001, a golf ball having a larger diameter, with the specific gravity of the cover or the mantle layer being great is disclosed.

An object of the present invention is to further improve the flight performance of a golf ball having a large diameter. In other words, an object of the present invention is to provide a golf ball which is excellent in both terms of the easiness upon hitting and travel distance.

SUMMARY OF THE INVENTION

A golf ball according to the present invention has a diameter D of 43.0 mm or greater and 50.0 mm or less. This golf ball has a core and a cover. Specific gravity of this cover is 1.05 or greater and 1.50 or less. The moment of inertia of this golf ball is equal to or greater than 85.0 $gcm^2$.

This golf ball is hard to embed into the grass because of its large diameter. Accordingly, golfers can hit this golf ball with ease. On behalf of the synergistic effect derived from the great specific gravity of the cover and the great moment of inertia, this golf ball gives slow spin speed immediately after the impact and provides a large launch angle. The trajectory is thereby optimized. Because this golf ball has a large diameter, air resistance during the flight is large, however, compensation is effected by the optimized trajectory. This golf ball is excellent in the flight performance. In light of the flight performance, the moment of inertia is preferably equal to or greater than 88.0 $gcm^2$.

Preferably, the moment of inertia is equal to or greater than the value Y calculated by the following mathematical formula (I):

$$Y=3.57\cdot D-68.6 \quad \text{(I)}.$$

This golf ball is extremely excellent in the flight performance.

DESCRIPTION OF THE PREFERRED EMBODIMENTS

The present invention is hereinafter described in detail with appropriate references to the accompanying drawing according to the preferred embodiments of the present invention.

Figure 1:
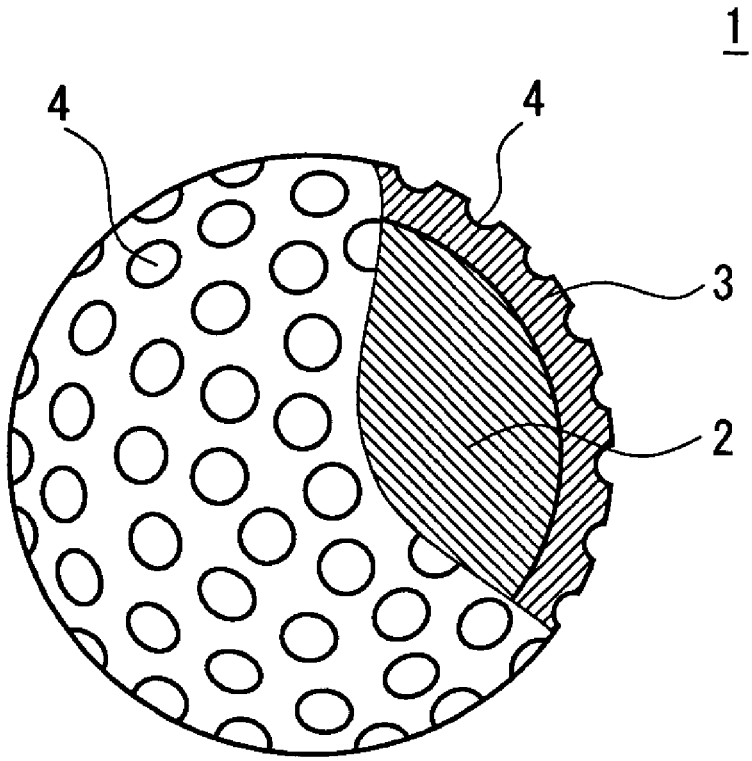
FIG. 1 is a schematic view illustrating a golf ball according to one embodiment of the present invention with a partially cut off cross-section.

A golf ball depicted in FIG. 1 has a spherical core and a cover. Numerous dimples are formed on the surface of the cover. This golf ball has a paint layer and a mark layer to the external side of the cover, although not shown in the Figure. The weight of this golf ball 1 is generally 40 g or greater and 50 g or less and particularly 44 g or greater and 47 g or less. In light of the elevation of inertia in the range to comply with a rule defined by USGA, the weight is preferably 45.00 g or greater and 45.93 g or less.

This golf ball is larger than usual golf balls, and has a diameter of equal to or greater than 43.0 mm. The golf ball hit on a tee ground flies, and then sits on the grass of the fairway or rough, or on the sand of the banker. Because the golf ball having the large diameter is hard to embed into the green or sand when it stops, the golfer can hit this golf ball with ease. Large diameter is responsible for suppression of missed hitting. In this respect, the diameter is preferably equal to or greater than 43.5 mm, and more preferably equal to or greater than 44.0 mm.

When the diameter is too large, compensation of the flight performance becomes difficult even if the improvement of the moment of inertia is achieved as described below. In this respect, the diameter is required to be equal to or less than 50.0 mm, preferably equal to or less than 48.0 mm, and particularly preferably equal to or less than 47.0 mm.

The core is formed by crosslinking of a rubber composition. Examples of suitable base rubber for use in the core include polybutadienes, polyisoprenes, styrene-butadiene copolymers, ethylene-propylene-diene copolymers and natural rubbers. Two or more kinds of these rubbers may be used in combination. In view of the resilience performance, it is preferred that polybutadiene is included as a predominant component. Specifically, the proportion of polybutadiene occupied in total base rubber is preferably equal to or greater than 50% by weight, and particularly preferably equal to or greater than 80% by weight. High cis-polybutadienes are preferred, which have a percentage of cis-1,4 bond of equal to or greater than 40%, and particularly equal to or greater than 80%.

For crosslinking of the core, a co-crosslinking agent is usually used. Preferable co-crosslinking agent in view of the resilience performance is a monovalent or bivalent metal salt of α,β-unsaturated carboxylic acid having 2 to 8 carbon atoms. Specific examples of the preferable co-crosslinking agent include zinc acrylate, magnesium acrylate, zinc methacrylate and magnesium methacrylate. Zinc acrylate is particularly preferred on the ground that a high resilience performance can be achieved.

The amount of the co-crosslinking agent to be blended is preferably 15 parts by weight or greater and 40 parts by weight or less per 100 parts by weight of the base rubber. When the amount to be blended is less than the above range, the resilience performance of the golf ball may become insufficient. In this respect, the amount to be blended is more preferably equal to or greater than 20 parts by weight, and particularly preferably equal to or greater than 22 parts by weight. When the amount to be blended is beyond the above range, the feel at impact of the golf ball may become hard. In this respect, the amount to be blended is more preferably equal to or less than 35 parts by weight, and particularly preferably equal to or less than 32 parts by weight.

In the rubber composition for use in the core, an organic peroxide may be preferably blended together with the co-crosslinking agent. The organic peroxide is responsible for the crosslinking reaction. By blending the organic peroxide, the resilience performance of the golf ball may be improved. Examples of suitable organic peroxide include dicumyl peroxide, 1,1-bis(t-butylperoxy)-3,3,5-trimethylcyclohexane, 2,5-dimethyl-2,5-di(t-butylperoxy)hexane and di-t-butyl peroxide. Particularly versatile organic peroxide is dicumyl peroxide.

The amount of the organic peroxide to be blended is preferably 0.1 part by weight or greater and 3.0 parts by weight or less per 100 parts by weight of the base rubber. When the amount to be blended is less than the above range, the resilience performance of the golf ball may become insufficient. In this respect, the amount to be blended is more preferably equal to or greater than 0.2 part by weight, and particularly preferably equal to or greater than 0.3 part by weight. When the amount to be blended is beyond the above range, the feel at impact of the golf ball may become hard. In this respect, the amount to be blended is more preferably equal to or less than 2.8 parts by weight, and particularly preferably equal to or less than 2.5 parts by weight.

The rubber composition for use in the core may be blended with a filler for the purpose of adjusting specific gravity and the like. Typical filler is an inorganic salt. Illustrative examples of suitable inorganic salt include zinc oxide, barium sulfate, calcium carbonate and magnesium carbonate. Powder of highly dense metal may be blended as a filler. Specific examples of the highly dense metal include tungsten and molybdenum. The amount of the filler to be blended is determined ad libitum so that the intended specific gravity of the core can be accomplished. Particularly preferable filler is zinc oxide. Zinc oxide serves not only as a mere agent for adjusting the specific gravity but also as a crosslinking activator. Various kinds of additives such as sulfur, an anti-aging agent, a coloring agent, a plasticizer, a dispersant a peptizing agent, a foaming agent and the like may also be blended at an appropriate amount to the rubber composition as needed. The rubber composition may be blended with crosslinked rubber powder or synthetic resin powder.

The cover is generally composed of a resin composition. Example of suitable base resin in the resin composition include ionomer resins, thermoplastic polyurethane elastomers, thermoplastic polyamide elastomers, thermoplastic polyester elastomers and thermoplastic styrene elastomers. Two or more kinds of the resins may be used in combination. The cover may be blended with a diene block copolymer.

Examples of suitable ionomer resin include copolymers of α-olefin and an α,β-unsaturated carboxylic acid having 3 to 8 carbon atoms in which part of the carboxylic acid is neutralized with a metal ion. Preferable α-olefin is ethylene and propylene. Preferable α,β-unsaturated carboxylic acid is acrylic acid and methacrylic acid. Illustrative examples of the metal ion for use in the neutralization include sodium ion, potassium ion, lithium ion, zinc ion, calcium ion, magnesium ion, aluminum ion and neodymium ion. The neutralization may also be carried out with two or more kinds of the metal ions. In light of the resilience performance and durability of the golf ball, particularly suitable metal ions are sodium ion, zinc ion, lithium ion and magnesium ion.

Specific examples of the ionomer resin include "Himilan 1555", "Himilan 1557", "Himilan 1601", "Himilan 1605", "Himilan 1652", "Himilan 1705", "Himilan 1706", "Himilan 1707", "Himilan 1855" and "Himilan 1856", trade names by Mitsui-Dupont Polychemical Co. Ltd. Other specific examples include "Surlyn® 7311", "Surlyn® 8120", "Surlyn® 8320", "Surlyn® 8940", "Surlyn® 8945", "Surlyn® 9910", "Surlyn® 9945", "Surlyn® AD8511" and "Surlyn® AD8512", trade names by Dupont. Still other specific examples include "IOTEK 7010", "IOTEK 8000", trade names by Exxon Corporation, and the like.

Examples of the thermoplastic polyurethane elastomer include "Elastolan", trade name by BASF Polyurethane Elastomers Ltd., and more specifically, "Elastolan ET880" can be exemplified. Examples of the thermoplastic polyamide elastomer include "Pebax®", trade name by Toray Industries, Inc., and more specifically, "Pebax®2533" can be exemplified. Examples of the thermoplastic polyester elastomer include "Hytrel®", trade name by Dupont-Toray Co., Ltd., and more specifically, "Hytrel® 3548" and "Hytrel® 4047" can be exemplified.

Examples of the thermoplastic styrene elastomer (thermoplastic elastomer containing a styrene block) include styrene-butadiene-styrene block copolymers (SBS), styrene-isoprene-styrene block copolymers (SIS), styrene-isoprene-butadiene-styrene block copolymers (SIBS) hydrogenated SBS, hydrogenated SIS and hydrogenated SIBS. Exemplary hydrogenated SBS include styrene-ethylene-butylene-styrene block copolymers (SEBS) Exemplary hydrogenated SIS include styrene-ethylene-propylene-styrene block copolymers (SEPS) Exemplary hydrogenated SIBS include styrene-ethylene-ethylene-propylene-styrene block copolymers (SEEPS). Specific examples of the thermoplastic styrene elastomer include "Rabalon®", trade name by Mitsubishi Chemical Corporation, and more specifically, "Rabalon® SR04" can be exemplified.

The aforementioned diene block copolymer has a block of which principal element is a vinyl aromatic compound, and a block of which principal element is a conjugated diene compound. The diene block copolymer has a double bond derived from the conjugated diene compound. A partially hydrogenated diene block copolymer can be also used suitably. Examples of the vinyl aromatic compound include styrene, α-methylstyrene, vinyltoluene, p-t-butylstyrene and 1,1-diphenylstyrene, and one or more kinds are selected among these. In particular, styrene is suitable. Illustrative examples of the conjugated diene compound include butadiene, isoprene, 1,3-pentadiene and 2,3-dimethyl-1,3-butadiene, and one or more kinds are selected among these. In particular, suitable examples include butadiene and isoprene, and a combination thereof. Examples of preferable diene block copolymer include: those of which structure be SBS (styrene-butadiene-styrene) having a polybutadiene block containing epoxy groups; and those of which structure be SIS (styrene-isoprene-styrene) having a polyisoprene block containing epoxy groups. Specific examples of the diene block copolymer include "Epofriend®", trade name by Daicel Chemical Industries, Ltd., and more specifically, "Epofriend® A1010" can be exemplified.

The specific gravity of the cover is 1.05 or greater and 1.50 or less. This specific gravity is greater than the specific gravity of usual golf balls. The cover having great specific gravity is responsible for lowering of the initial spin speed. In this respect, the specific gravity is more preferably equal to or greater than 1.10, and particularly preferably equal to or greater than 1.15. When the specific gravity is beyond the above range, the resilience performance of the golf ball may become insufficient. In this respect, the specific gravity is more preferably equal to or less than 1.45, and particularly preferably equal to or less than 1.40.

Adjustment of the specific gravity of the cover can be achieved by blending a filler. Illustrative examples of preferable filler include zinc oxide, barium sulfate, titanium dioxide, tungsten powder and molybdenum powder. To the cover may be blended a coloring agent, a dispersant, an anti-aging agent, an ultraviolet absorbent, a light stabilizer, a fluorescent agent, a fluorescent brightening agent and the like in an appropriate amount as needed.

Thickness of the cover is preferably 0.5 mm or greater and 2.3 mm or less. When the thickness is less than the above range, forming of the cover may involve difficulty, and durability of the golf ball may become insufficient. In this respect, the thickness is more preferably equal to or greater than 0.6 mm, and particularly preferably equal to or greater than 0.7 mm. When the thickness is beyond the above range, the feel at impact of the golf ball may become hard. In this respect, the thickness is more preferably equal to or less than 2.2 mm, and particularly preferably equal to or less than 2.1 mm.

The moment of inertia of the golf ball is greater than the moment of inertia of usual golf balls, and is equal to or greater than 85.0 $gcm^2$. Great moment of inertia is responsible for lowering of the initial spin speed and increase of the launch angle. A golf ball hit with a low initial spin speed and large launch angle flies with no hopping accompanied. Long travel distance is achieved by this golf ball. In this respect, the moment of inertia is more preferably equal to or greater than 86.0 $gcm^2$, and particularly preferably equal to or greater than 88.0 $gcm^2$. The moment of inertia yielded by general materials for golf balls is equal to or less than 150 $gcm^2$, and particularly equal to or less than 130 $gcm^2$.

Figure 2:
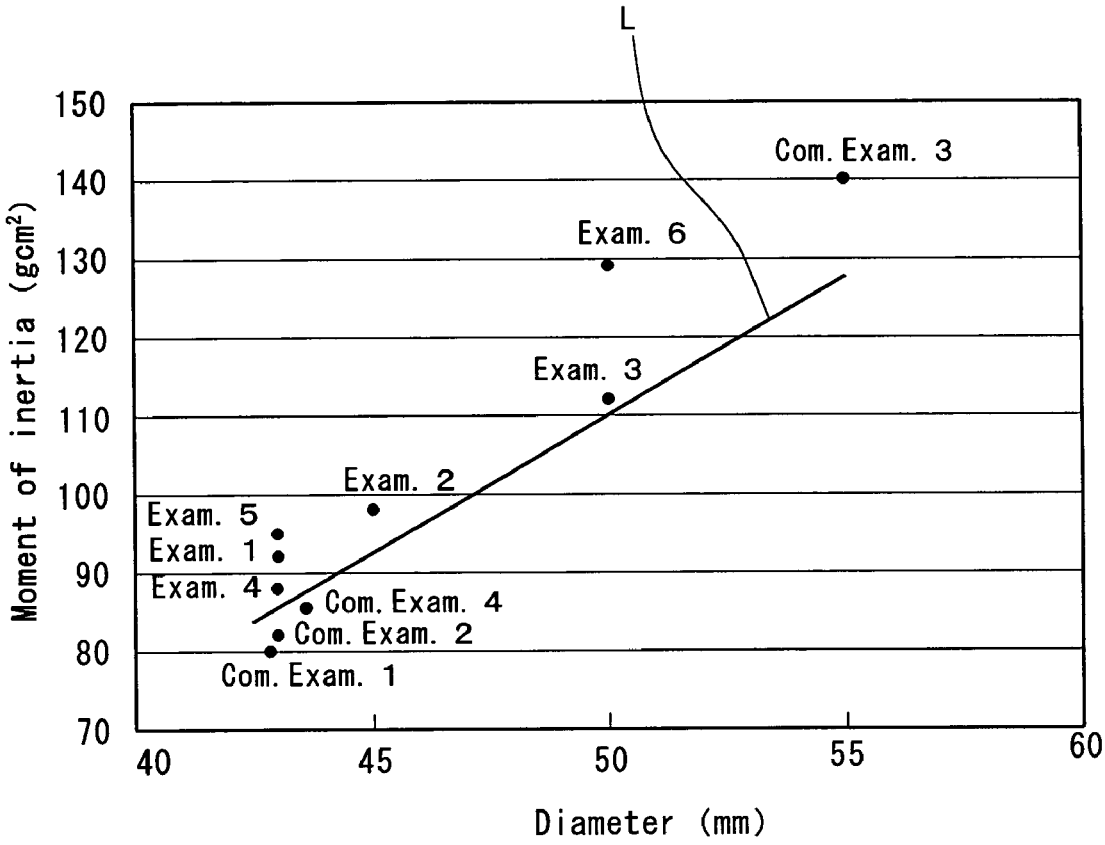
FIG. 2 is a graph showing the relationship between the moment of inertia and the diameter.

The straight line indicated by the reference sign L in the graph illustrated in FIG. 2 is represented by the following mathematical formula (I). In light of both terms of the easiness upon hitting and flight performance, a golf ball corresponding to the location just on the straight line L, or in the upper region of the straight line L is preferred. In other words, it is preferred that the moment of inertia is equal to or greater than the value Y calculated by the following mathematical formula (I):

$$Y=3.57\cdot D-68.6 \quad \text{(I)}.$$

In the above mathematical formula (I), D is the diameter of a golf ball. A golf ball having a large diameter D tends to have great moment of inertia. In the golf ball having the moment of inertia which is equal to or greater than the value Y calculated by the formula (I), increase of the moment of inertia is contemplated not only by the large diameter but also by other factor. This golf ball is extremely excellent in the flight performance.

A mid layer may be formed between the core and the cover. The mid layer may be composed of a rubber composition which is similar to that for the core, or may be composed of a resin composition which is similar to that for use in the cover. Specific gravity of the mid layer is preferably 1.10 or greater and 1.50 or less. Thickness of the mid layer is preferably 0.5 mm or greater and 2.3 mm or less. The mid layer may be composed of two or more layers.

Total number of dimples is preferably 300 or greater and 700 or less. When the total number is less than the above range, there is a possibility that the fundamental feature of the golf ball which is a substantially spherical body may not be sustained. In this respect, total number is more preferably equal to or more than 360. When the total number is beyond the above range, a drag coefficient (Cd) may be so large that the travel distance may become insufficient. In this respect, total number is more preferably equal to or less than 600.

Total volume V of the dimples is preferably 400 $mm^3$ or greater and 900 $mm^3$ or less. When the total volume V is less than the above range, hopping trajectory may be provided. In this respect, the total volume V is more preferably equal to or greater than 450 $mm^3$, and particularly preferably equal to or greater than 500 $mm^3$. When the total volume V is beyond the above range, dropping trajectory may be provided. In this respect, the total volume V is more preferably equal to or less than 880 $mm^3$. The volume of the dimple herein means volume of a space surrounded by a phantom spherical surface (a surface of the golf ball when it was postulated that there is no dimple existed) and the surface of the dimple.

Surface area occupation percentage of the dimples is preferably 65% or greater and 95% or less. When the surface area occupation percentage is less than the above range, lift force of the golf ball during the flight may be deficient. In this respect, the surface area occupation percentage is more preferably equal to or greater than 70%. When the surface area occupation percentage is beyond the above range, a trajectory of the golf ball may become too high. In this respect, the surface area occupation percentage is more preferably equal to or less than 90%.

Plane shape of the dimples may be either circular or non-circular. Specific examples of the non-circular dimple include polygonal, elliptical, oval and tear drops-like shaped dimples. The sectional shape of the dimple may be either single radius or double radius.

EXAMPLES

Example 1

A rubber composition was obtained through kneading 100 parts by weight of high cis-polybutadiene ("BR-01", trade name by JSR Corporation), 25 parts by weight of zinc acrylate, an appropriate amount of zinc oxide, 0.8 part by weight of dicumyl peroxide and 0.5 part by weight of diphenyl disulfide. This rubber composition was placed into a mold having a spherical cavity, and kept at 160° C. for 23 minutes to obtain a core having a diameter of 38.6 mm. Next, a resin composition was obtained through kneading 50 parts by weight of an ionomer resin (the above described trade name "Himilan 1605"), 50 parts by weight of other ionomer resin (the above described trade name "Himilan 1706"), 51 parts by weight of barium sulfate and 2 parts by weight of titanium dioxide. Then, the core was placed into a mold having a spherical cavity, and thereafter the resin composition that had been melted by heating was injected around the spherical body to obtain a cover having a thickness of 2.2 mm. In parallel with the formation of the cover, the dimple pattern of type II shown in the following Table 1 was formed. Known coating material was painted to this cover, and thus a golf ball of Example 1 was obtained. This golf ball had a diameter of 43.0 mm. The amount of zinc oxide to be blended was adjusted to give the weight of the golf ball of 45.4 g.

Examples 2 to 4, Example 6 and Comparative Examples 1 to 3

In a similar manner to Example 1, golf balls of Examples 2 to 4, Example 6 and Comparative Examples 1 to 3 were obtained except that the constitutions were altered as shown in Table 2 and Table 3 below, and the mold was changed.

Example 5

A rubber composition was obtained through kneading 100 parts by weight of high cis-polybutadiene (the above-described trade name "BR-01"), 25 parts by weight of zinc acrylate, an appropriate amount of zinc oxide, 0.6 part by weight of dicumyl peroxide and 0.5 part by weight of diphenyl disulfide. This rubber composition was placed into a mold having a spherical cavity, and kept at 160° C. for 23 minutes to obtain a core having a diameter of 37.4 mm. Next, a resin composition was obtained through kneading 100 parts by weight of a thermoplastic polyurethane elastomer (the above described trade name "Elastolan ET880") and 40 parts by weight of tungsten powder. Then, the core was placed into a mold having a spherical cavity, and thereafter the resin composition that had been melted by heating was injected around the spherical body to obtain a mid layer having a thickness of 1.4 mm. Next, a resin composition was obtained through kneading 50 parts by weight of an ionomer resin (the above described trade name "Surlyn® 8945"), 40 parts by weight of other ionomer resin (the above described trade name "Surlyn® 9945"), 10 parts by weight of a thermoplastic styrene elastomer (the above described trade name "Rabalon® SR04"), 48 parts by weight of barium sulfate and 5 parts by weight of titanium dioxide. Then, the spherical body including the core and the mid layer was placed into a mold having a spherical cavity, and thereafter the resin composition that had been melted by heating was injected around the spherical body to obtain a cover having a thickness of 1.4 mm. In parallel with the formation of the cover, the dimple pattern of type II shown in the following Table 1 was formed. Known coating material was painted to this cover, and thus a golf ball of Example 5 was obtained. This golf ball had a diameter of 43.0 mm. The amount of zinc oxide to be blended was adjusted to give the weight of the golf ball of 45.4 g.

Comparative Examples 4

In a similar manner to Example 5, a golf ball of Comparative Examples 4 was obtained except that the constitution was altered as shown in Table 3 below, and the mold was changed.

TABLE 1

| | | Specification of Dimples | | | | | | | |
|---|---|---|---|---|---|---|---|---|---|
| | | Number | Diameter (mm) | Depth (mm) | Curvature (mm) | Volume ($mm^3$) | Total Number | Total Volume ($mm^3$) | Occupation Percentage (%) |
| Type I | A dimple | 186 | 4.100 | 0.2311 | 15.92 | 1.528 | 390 | 503.8 | 79.0 |
| | B dimple | 114 | 3.850 | 0.2195 | 14.05 | 1.279 | | | |
| | C dimple | 60 | 3.550 | 0.2064 | 11.96 | 1.023 | | | |
| | D dimple | 30 | 2.500 | 0.1691 | 5.96 | 0.416 | | | |
| Type II | A dimple | 186 | 4.130 | 0.2326 | 16.07 | 1.560 | 390 | 514.4 | 79.0 |
| | B dimple | 114 | 3.878 | 0.2208 | 14.18 | 1.306 | | | |
| | C dimple | 60 | 3.576 | 0.2077 | 12.07 | 1.044 | | | |
| | D dimple | 30 | 2.518 | 0.1701 | 6.02 | 0.425 | | | |
| Type III | A dimple | 186 | 4.321 | 0.2435 | 16.80 | 1.787 | 390 | 589.4 | 79.0 |
| | B dimple | 114 | 4.058 | 0.2312 | 14.82 | 1.496 | | | |
| | C dimple | 60 | 3.741 | 0.2174 | 12.61 | 1.197 | | | |
| | D dimple | 30 | 2.635 | 0.1781 | 6.29 | 0.487 | | | |
| Type IV | A dimple | 186 | 4.801 | 0.2705 | 18.67 | 2.451 | 390 | 808.4 | 79.0 |
| | B dimple | 114 | 4.508 | 0.2568 | 16.47 | 2.052 | | | |
| | C dimple | 60 | 4.157 | 0.2416 | 14.01 | 1.641 | | | |
| | D dimple | 30 | 2.927 | 0.1979 | 6.99 | 0.668 | | | |
| Type V | A dimple | 186 | 5.281 | 0.2976 | 20.53 | 3.263 | 390 | 1076.0 | 79.0 |
| | B dimple | 114 | 4.959 | 0.2825 | 18.11 | 2.732 | | | |
| | C dimple | 60 | 4.573 | 0.2657 | 15.41 | 2.185 | | | |
| | D dimple | 30 | 3.220 | 0.2177 | 7.69 | 0.889 | | | |

TABLE 2

| | | Specification of Golf Ball | | | | |
|---|---|---|---|---|---|---|
| | | Example 1 | Example 2 | Example 3 | Example 4 | Example 5 |
| Core | BR-01 | 100 | 100 | 100 | 100 | 100 |
| | Zinc acrylate | 25 | 25 | 30 | 30 | 25 |
| | Zinc oxide | Appropriate amount | Appropriate amount | Appropriate amount | Appropriate amount | Appropriate amount |
| | Dicumyl peroxide | 0.8 | 0.8 | 0.5 | 0.6 | 0.6 |
| | Sulfur | — | — | — | — | — |
| | Diphenyl disulfide | 0.5 | 0.5 | 0.5 | 0.5 | 0.5 |
| | Diameter (mm) | 38.6 | 42.2 | 49.0 | 42.0 | 37.4 |
| Mid layer | ET880 | — | — | — | — | 100 |
| | Tungsten powder | — | — | — | — | 40 |
| | Specific gravity | — | — | — | — | 1.5 |
| | Thickness (mm) | — | — | — | — | 1.4 |
| Cover | Surlyn ® 8945 | — | 45 | 35 | 35 | 50 |
| | Surlyn ® 9945 | — | 45 | 35 | 35 | 40 |
| | Himilan 1555 | — | — | 20 | 30 | — |
| | Himilan 1605 | 50 | — | — | — | — |
| | Himilan 1706 | 50 | — | — | — | — |
| | Himilan 1855 | — | 10 | — | — | — |
| | Rabalon ® SR04 | — | — | 10 | — | 10 |
| | Barium sulfate | 51 | 52 | 11 | 90 | 48 |
| | Titanium dioxide | 2 | — | 3 | 2 | 5 |
| | Specific gravity | 1.3 | 1.3 | 1.05 | 1.5 | 1.3 |
| | Thickness (mm) | 2.2 | 1.4 | 0.5 | 0.5 | 1.4 |

TABLE 3

| | | Specification of Golf Ball | | | | |
|---|---|---|---|---|---|---|
| | | Example 6 | Comparative Example 1 | Comparative Example 2 | Comparative Example 3 | Comparative Example 4 |
| Core | BR-01 | 100 | 100 | 100 | 100 | 100 |
| | Zinc acrylate | 25 | 25 | 25 | 30 | 20 |
| | Zinc oxide | Appropriate amount | Appropriate amount | Appropriate amount | Appropriate amount | Appropriate amount |
| | Zinc stearate | — | — | — | — | 20 |
| | TG regrind | — | — | — | — | 10 |
| | 231XL | — | — | — | — | 0.9 |
| | Dicumyl peroxide | 1.1 | 0.8 | 0.8 | 0.5 | — |
| | Sulfur | 0.1 | — | — | — | — |
| | Diphenyl disulfide | 0.5 | 0.5 | 0.5 | 0.5 | — |
| | Diameter (mm) | 45.6 | 38.3 | 38.6 | 54.0 | 38.1 |
| Mid layer | IOTEK 8000 | — | — | — | — | 50 |
| | Surlyn ® 7311 | — | — | — | — | 50 |
| | Stainless steel powder | — | — | — | — | 30 |
| | Thickness (mm) | — | — | — | — | 1.3 |
| Cover | Surlyn ® 8120 | — | — | — | — | 17.5 |
| | Surlyn ® 8320 | — | — | — | — | 7.5 |
| | Surlyn ® 8940 | — | — | — | — | 16.5 |
| | Surlyn ® 8945 | 50 | — | — | 35 | — |
| | Surlyn ® 9910 | — | — | — | — | 49.1 |
| | Surlyn ® 9945 | 50 | — | — | 35 | — |
| | Himilan 1555 | — | — | — | 20 | — |
| | Himilan 1605 | — | 50 | 50 | — | — |
| | Himilan 1706 | — | 50 | 50 | — | — |
| | Rabalon ® SR04 | — | — | — | 10 | — |
| | IOTEK 7030 | — | — | — | — | 7.05 |
| | Barium sulfate | 50 | — | — | 11 | — |

TABLE 3-continued

| | Specification of Golf Ball | | | | |
|---|---|---|---|---|---|
| | Example 6 | Comparative Example 1 | Comparative Example 2 | Comparative Example 3 | Comparative Example 4 |
| Titanium dioxide | 2 | 2 | 2 | 3 | 2.35 |
| Specific gravity | 1.3 | 0.98 | 0.98 | 1.05 | 0.98 |
| Thickness (mm) | 2.2 | 2.2 | 2.2 | 0.5 | 1.4 |

[Travel Distance Test]

A driver with a metal head (Sumitomo Rubber Industries, Ltd., "XXIO W#1", loft: 10°, hardness of the shaft: S) was equipped with a swing machine (manufactured by True Temper Co.). Then the machine condition was set to give the head speed of 40 m/sec. Golf balls which had been kept at the temperature of 23° C. were hit with this swing machine, and the launch angle, initial spin speed, carry (i.e., the distance from the launching point to the fall point) and total (i.e., the distance from the launching point to the point where the ball stopped) were measured accordingly. Mean values of 5 times measurement are shown in Table 4 below.

TABLE 4

| | Results of Evaluation | | | | | | | | | |
|---|---|---|---|---|---|---|---|---|---|---|
| | Example 1 | Example 2 | Example 3 | Example 4 | Example 5 | Example 6 | Comparative Example 1 | Comparative Example 2 | Comparative Example 3 | Comparative Example 4 |
| Diameter (mm) | 43.0 | 45.0 | 50.0 | 43.0 | 43.0 | 50.0 | 42.7 | 43.0 | 55.0 | 43.4 |
| Moment of inertia ($gcm^2$) | 92.0 | 98.0 | 112.0 | 88.0 | 94.0 | 129.0 | 80.0 | 82.0 | 140.0 | 83.0 |
| Specific gravity of cover | 1.30 | 1.30 | 1.05 | 1.50 | 1.30 | 1.30 | 0.98 | 0.98 | 1.05 | 0.98 |
| Dimple type | II | III | IV | II | II | IV | I | II | V | II |
| Launch angle (degree) | 12.3 | 12.2 | 12.4 | 12.2 | 12.2 | 12.5 | 11.8 | 11.9 | 12.6 | 12.0 |
| Initial spin speed (rpm) | 2600 | 2500 | 2450 | 2650 | 2600 | 2350 | 2800 | 2750 | 2300 | 2700 |
| Carry (m) | 192 | 194 | 192 | 193 | 193 | 193 | 189 | 190 | 189 | 189 |
| Total (m) | 210 | 212 | 212 | 211 | 212 | 211 | 206 | 208 | 208 | 208 |

In Table 4, it is presented that the golf ball of each of the Examples achieves longer travel distance than golf balls of the Comparative Examples. Accordingly, advantages of the present invention are clearly indicated by the results of evaluation.

The description herein above is merely for illustrative examples, therefore, various modifications can be made without departing from the principles of the present invention.

What is claimed is:

1. A golf ball having the diameter D of 43.0 mm or greater and 50.0 mm or less, which comprises a core and a cover having the specific gravity of 1.05 or greater and 1.50 or less, with the moment of inertia of said golf ball being equal to or greater than 92 $gcm^2$.

2. The golf ball according to claim 1 wherein the moment of inertia is equal to or greater than the value Y calculated by the following mathematical formula (I) where Y is equal to or greater than 92:

$$Y=3.57\cdot D-68.6 \quad \text{(I)}.$$

3. The golf ball according to claim 1 wherein the diameter D is 43.5 mm or greater and 48.0 mm or less.

4. The golf ball according to claim 1 wherein the diameter D is 44.0 mm or greater and 47.0 mm or less.

5. The golf ball according to claim 1 wherein the specific gravity is 1.10 or greater and 1.45 or less.

6. The golf ball according to claim 1 wherein the specific gravity is 1.15 or greater and 1.40 or less.

7. The golf ball according to claim 1 wherein the moment of inertia is equal to or less than 150 $gcm^{2.}$ 8. The golf ball according to claim 1 wherein the moment of inertia is equal to or less than 130 $gcm^{2.}$ 9. The golf ball according to claim 3 wherein the moment of inertia is equal to or greater than the value Y calculated by the following mathematical formula (I) where Y is equal to or greater than 92:

$$Y=3.57\cdot D-68.6 \quad \text{(I)}.$$

10. The golf ball according to claim 4 wherein the moment of inertia is equal to or greater than the value Y calculated by the following mathematical formula (I) where Y is equal to or greater than 92:

$$Y=3.57\cdot D-68.6 \quad \text{(I)}.$$

* * * * *